US007063737B2

(12) United States Patent
Tilby et al.

(10) Patent No.: US 7,063,737 B2
(45) Date of Patent: Jun. 20, 2006

(54) SOFT WEAPON CASE

(76) Inventors: V. John Tilby, 499 E. Big Sky Dr., Sandy, UT (US) 84070; Daniel M. Tilby, 543 Goldstein Pheasant Dr., Draper, UT (US) 80628

( * ) Notice: Subject to any disclaimer, the term of this patent is extended or adjusted under 35 U.S.C. 154(b) by 7 days.

(21) Appl. No.: 10/436,538

(22) Filed: May 14, 2003

(65) Prior Publication Data

US 2004/0226793 A1 Nov. 18, 2004

(51) Int. Cl.
*A45C 13/00* (2006.01)
*B65D 85/30* (2006.01)

(52) U.S. Cl. ..... 106/317; 206/523; 190/125

(58) Field of Classification Search ..... 190/125; 206/317, 523, 524, 314; 224/911, 913; 383/110
See application file for complete search history.

(56) References Cited

U.S. PATENT DOCUMENTS 2,623,566 A * 12/1952 Kibler ..... 190/125
4,446,900 A * 5/1984 Markovich ..... 206/317
4,480,715 A * 11/1984 Brooks ..... 181/287
4,836,374 A * 6/1989 Hutchins et al. ..... 206/373
5,445,251 A * 8/1995 Redwood ..... 190/109
5,669,495 A * 9/1997 West ..... 206/317
6,009,996 A * 1/2000 Purdy ..... 206/317
6,547,070 B1 * 4/2003 Kolpin ..... 206/317
2003/0201198 A1 * 10/2003 Gantert

* cited by examiner

*Primary Examiner*—Sue A. Weaver
(74) *Attorney, Agent, or Firm*—Morriss O'Bryant Compagni, P.C.

(57) ABSTRACT

A soft case for holding weapons as they are transported or stored that has a clam-shell type body with an upper half body and a lower half body interconnected by a hinge and with the upper and lower half bodies and hinge made from a foam plastic that is soft enough to protect a weapon surrounded by body and capable of being permanently shaped under heat and pressure to have one-half of a weapon molded as a recess in the upper half body and an opposite side one-half of the weapon molded as a recess in the lower half body whereby when the upper and lower body halves are pivoted about the hinge and into face to face relationship, with a weapon positioned in the recesses formed in the half bodies and including a zipper for securing the body halves together and a handle for carrying the gun case.

1 Claim, 3 Drawing Sheets

SOFT WEAPON CASE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Field of the Invention

This invention relates to weapon cases and is particularly related to "soft" used for the storage and transportation of guns of varying sizes and shapes.

The weapon case of the invention is still further related to gun cases having clamshell type upper and lower hinged case body elements.

BRIEF SUMMARY OF THE INVENTION

Principal objects of the present invention are to provide a weapon case that includes molded body engagement pads to securely stabilize a gun positioned in the gun case and to protect the gun against damage should the case be dropped, fall or otherwise be subjected to significant shock forces.

Another object is to provide a durable weapon case that is relatively inexpensive to produce so that different versions suitable for different guns can be economically produced and marketed.

Still other objects are to provide a soft weapon case having sufficient rigidity to allow the case to be grasped and carried and to swing open and closed as a gun is positioned therein or removed there from.

Principal features of the invention include a clamshell type housing with a durable fabric outer cover and hinged together upper and lower body members with inside upper and lower pads. The inside pads are molded to have one actual side of a gun shape molded into the upper pad and the opposite actual side of the gun shape molded into the bottom pad. The pads are formed from a single piece of suitable foam material that is soft enough to cushion a gun placed in the case, yet firm enough to retain a molded shape when subjected to sufficient heat and pressure. A "living hinge" is molded into the foam material interconnecting the pads, and by use of a plurality of spaced parallel grooves is made to be sufficiently wide to allow the pads to come flat together, even when a gun is placed in the recessed molded shapes provided therefore in the pads.

The depths of the shapes molded into the upper and lower pads allow one-half of one side of a gun to fit into the upper pad and one-half of the gun to fit into the bottom pad. With the molded gun shapes being the same as the gun to be inserted the gun is fully surrounded and is unable to move, even slightly, within the gun case when the upper pad is closed over the lower pad.

An edging fabric is sewn around the outer edge of the hinge connected upper and lower pads and the exterior fabric. The edging fabric is for appearance purposes and to prevent separation of the fabrics from the foam material used as material for the upper and lower pads.

The edging fabric also secures a zipper half that surrounds each of the foam pads in place. Thus, when the upper and lower halves of the gun case are folded together the zipper is closed to secure a gun positioned in the gun case.

A strap is sewn, to the exterior fabric of each upper and lower half of the gun case. Each strap has its opposite ends spaced apart and sewn to the exterior fabric covering the hinge between the upper and lower halves of the gun case. Opposite lengths of each strap are sewn in parallel fashion to the exterior fabric to extend from the hinge side of the case to adjacent to an opposite edge of the case. The opposite lengths of strap are then commonly joined at a handle section. The handle section of each strap is formed by folding the central section of the strap in half, lengthwise, and sewing the folded halves together. The two handle sections of the attached two straps together form a handle for convenient carrying of the case.

Additional objects and features of the invention will become apparent to those skilled in the art to which the invention pertains from the following detailed description and drawings.

DETAILED DESCRIPTION OF THE INVENTION

Figure 1:
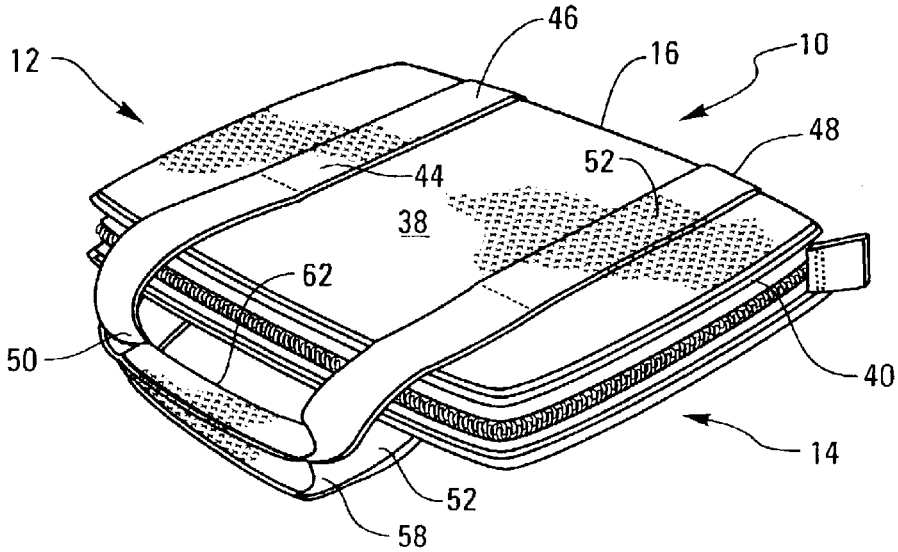
FIG. 1 is a perspective view of a gun case of the invention in a closed condition.
Figure 2:
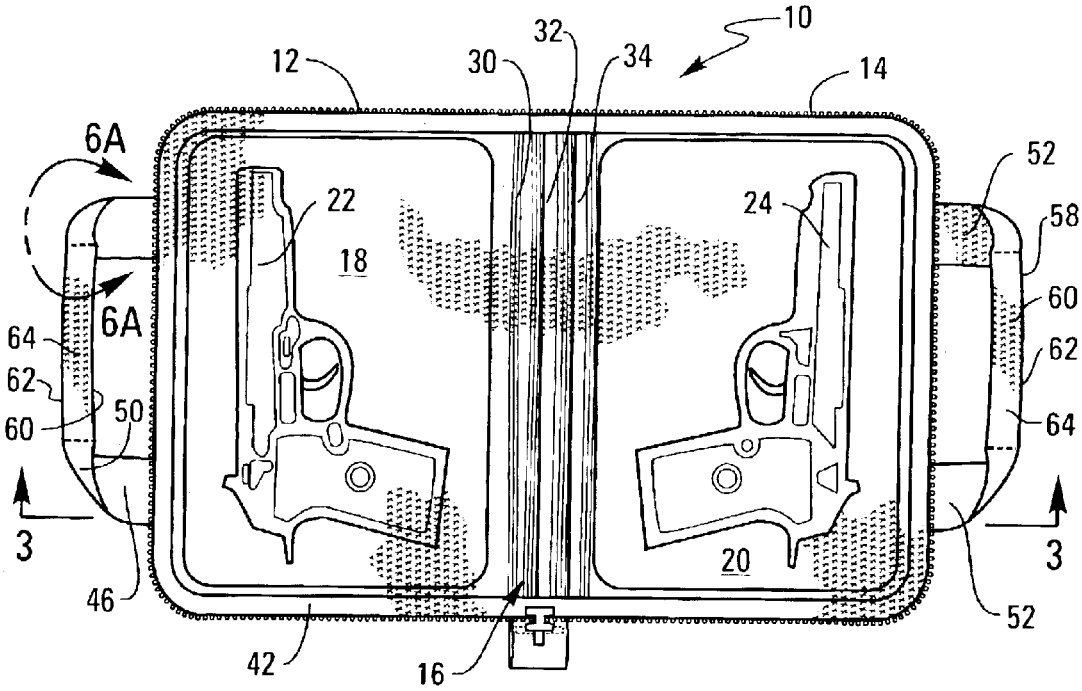
FIG. 2, an inside plan view of the gun case in an open condition.
Figure 3:
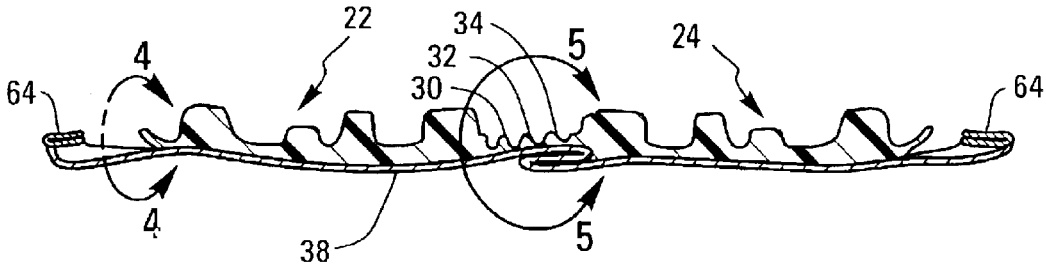
FIG. 3, a vertical section view, taken on the line 3—3 of FIG. 2.
Figure 4:
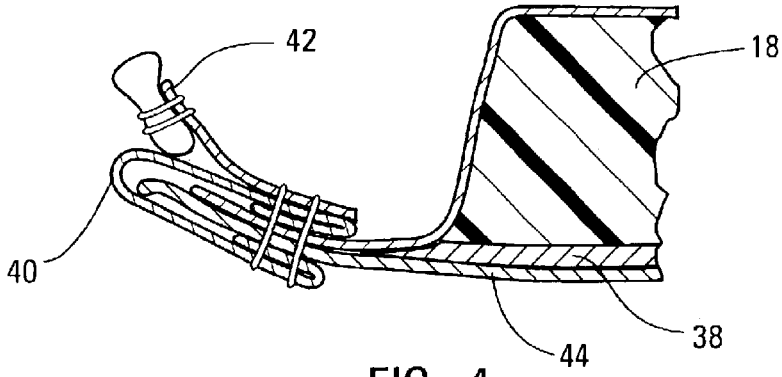
FIG. 4, an enlarged view, taken within the line 4—4 of FIG. 3.
Figure 5:
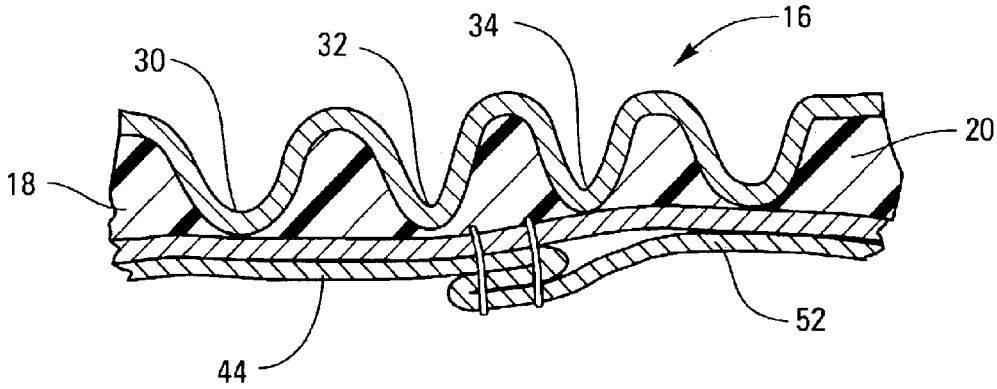
FIG. 5, an enlarged view, taken within the line 5—5 of FIG, 3.
Figure 6A:
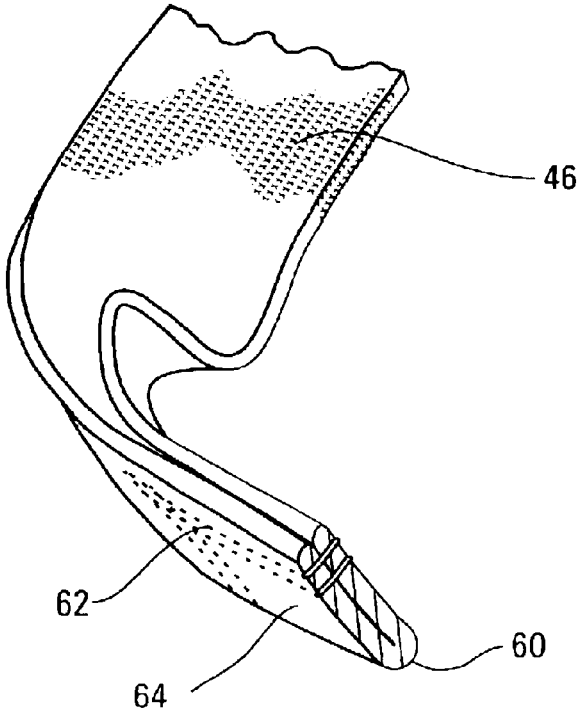
FIG. 6A, an enlarged view taken within the line 6A—6A.
Figure 6B:
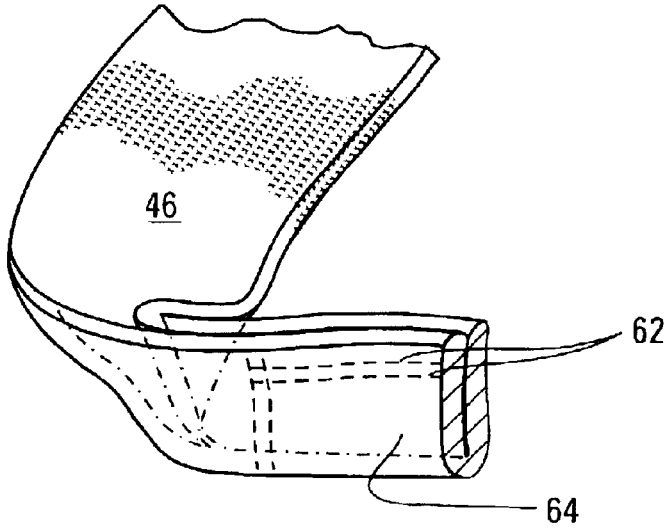
FIG. 6B, a view like that of FIG. 6A, but taken from a different angle.

Referring now to the drawings;

In the illustrated preferred embodiment the weapons case of the invention is shown generally at 10. Gun case 10 includes an upper half body 12 and a lower half body 14 connected in clam-shell configuration to swing open from a hinge 16. Upper half body 12 includes an inside pad 18 and lower half body 14 includes an inner pad 20. The pads 18 and 20 are formed by a single piece of thermo formable foam material, such as a cross-linked, closed cell, foam pad and are interconnected by the hinge 16.

The pads 18 and 20 are molded using sufficient heat and pressure to form gun shapes 22 and 24, respectively, molded into the pads and to form the "living hinge" 16. Gun shape 22 is an accurate female mold representation of one side of a gun (now shown) to be positioned in the gun case 10. To this end, one-half of the gun, including each component projecting from that side of the gun, is molded into the pad. Gun shape 24 is a similar female mold, including each component projecting from one-half of the gun at the side opposite the side depicted in shape 22.

Living hinge 16 comprises a plurality of parallel grooves 30, 32, and 34 spaced such that when the gun case is closed the non-shaped flat surfaces of the pads will rest flat on one another and a gun positioned in the shapes will be totally surrounded by the soft form material from which the pads and hinge are formed.

A fabric backing sheet 38, preferably made of a durable fabric 1 such as nylon, covers the side of the plastic foam material in which the pads 18 and 20 and hinge 16 are formed. A fabric edging 40 is sewn around the upper and lower halves and the perimeter of the fabric sheet 38 to secure the fabric sheet to the foam plastic from which the pads and hinge are formed and shaped.

A zipper 42 is also held in place by the edging 40 and extends from one end of hinge 16 around both the upper and lower body portions. The zipper is opened to provide access to the interior of the gun ease and is closed to seal the gun case.

A strap 44 has spaced 46 and 48 sewn to the fabric sheet 38 at the hinge 16 and between the hinge and to near the edge of upper half body 12 remote from the hinge. The ends 46 and 48 of strap 44 are connected by a central portion 50 of strap 44 a spaced distance beyond the edge of the half body 12. A strap 52 is similarly formed and similarly attached to the fabric sheet 38 to have spaced ends and connected to a central portion 58. Both central portions 50 and 58 are folded along their lengths at 60 and the folded halves are sewn together at 62 to form surfaces 64 of handles that can be used to carry the gun case 10.

Although a preferred embodiment of the invention has been herein disclosed, it is to be understood that such disclosure is by way of example and that other variations are possible without departing from the subject matter coming within the scope of the following claims, which subject matter we regard as our invention.

We claim:

1. A soft weapon case comprising a clam-shell body having an upper half body and a lower half body, said upper half body having a first inside pad, said lower half body having a second inside pad, a hinge means interconnecting said first and second inside pads, said hinge means being formed to permit said second inside pad to lie flat against said first inside pad;

said first inside pad, said second inside pad and said hinge means being integrally formed of foam plastic, said foam plastic being sufficiently soft to protect a weapon placed between said upper and lower half bodies and deformed under heat and pressure thereby forming recessed weapon shapes in each of said first and second pads with the shape in said first pad forming an exact mold of one-half of said weapon and the shape in second pad forming an exact mold of the other one-half of the weapon and said recessed mold shapes being arranged such that when said pads are folded together about said hinge means, said weapon is totally surrounded by said foam plastic;

a fabric sheet covering the first and second pads and the hinge means at a side opposite said shapes;

a fabric edging sewn around the periphery of said fabric sheet and outer edges of said upper and lower body halves and said hinge means;

zipper fastener means surrounding the outer edge of the upper and lower body halves to releasably secure said body halves together with the first and second inside pads being in face-to-face relationship; and handle means secured to the fabric sheet for carrying the gun case.

* * * * *